US007400100B2

(12) United States Patent
Takezawa

(10) Patent No.: US 7,400,100 B2
(45) Date of Patent: Jul. 15, 2008

(54) DISCHARGE-LAMP LIGHTING APPARATUS AND PROJECTOR

(75) Inventor: Takeshi Takezawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/713,034

(22) Filed: Mar. 2, 2007

(65) Prior Publication Data

US 2007/0228998 A1 Oct. 4, 2007

(30) Foreign Application Priority Data

Mar. 28, 2006 (JP) ..... 2006-087698

(51) Int. Cl.
*G05F 1/00* (2006.01)

(52) U.S. Cl. ..... 315/307; 315/308; 315/360; 315/291; 315/209 R; 315/224; 315/289; 315/DIG. 5; 315/DIG. 7; 353/30; 353/85; 349/7; 349/9

(58) Field of Classification Search ..... 315/224, 315/225, 289–291, 307, 308, 209 R, 297, 315/80, 82, 360, 362, DIG. 5, DIG. 7; 353/30–34, 353/37, 38, 98, 102, 85; 349/5–7, 9
See application file for complete search history.

(56) References Cited

U.S. PATENT DOCUMENTS 5,463,287 A 10/1995 Kurihara et al.
5,962,981 A * 10/1999 Okude et al. ..... 315/128
6,504,316 B2 * 1/2003 Ito et al. ..... 315/224
6,670,780 B2 * 12/2003 Ono et al. ..... 315/291
6,750,620 B2 * 6/2004 Suzuki ..... 315/291
6,943,503 B2 * 9/2005 Ozasa et al. ..... 315/224
6,960,886 B2 * 11/2005 Ishizuka ..... 315/80
6,984,943 B2 * 1/2006 Ono et al. ..... 315/291
7,052,141 B2 * 5/2006 Akiyama ..... 353/38
7,084,585 B2 * 8/2006 Yamamoto et al. ..... 315/291
2001/0020827 A1 9/2001 Ito et al.
2003/0160576 A1 8/2003 Suzuki
2005/0023993 A1 2/2005 Ono et al.
2005/0082986 A1 4/2005 Takezawa et al.

FOREIGN PATENT DOCUMENTS

JP A 7-73982 3/1995
JP B2 2942113 6/1999
JP A 2004-207018 7/2004

* cited by examiner

*Primary Examiner*—Haissa Philogene
(74) *Attorney, Agent, or Firm*—Oliff & Berridge, PLC

(57) ABSTRACT

A discharge-lamp lighting apparatus includes a control circuit that determines electric power supplied to a high-pressure discharge lamp after the high-pressure discharge lamp is started by an igniter. The electric power is determined in accordance with a voltage corresponding to a lamp voltage detected by a voltage detection circuit and a drive current detected by a current detection circuit. When the determined electric power is less than predetermined electric power, the control circuit causes a down chopper to control the drive current such that an amount of increase in the electric power per unit time becomes equal to or less than a predetermined value.

10 Claims, 5 Drawing Sheets

DISCHARGE-LAMP LIGHTING APPARATUS AND PROJECTOR

BACKGROUND

1. Field of the Invention

The present invention relates to a discharge-lamp lighting apparatus and a projector including the discharge-lamp lighting apparatus, and more particularly, to an operation of controlling a drive current at the start of the lamp.

2. Description of the Related Art

A discharge-lamp lighting apparatus is suggested in, for example, Japanese Patent No. 2942113 (claim 1). In this discharge-lamp lighting apparatus, while a lamp voltage is low in an initial stage of lighting, constant current control is performed in which a current supplied to the discharge lamp is controlled by a switching operation. Then, after the lamp voltage is stabilized, constant power control is performed in which electric power supplied to the discharge lamp is controlled by a switching operation. In this apparatus, a ratio of "on" period to "off" period of switching elements is controlled by changing a switching frequency of the switching elements. In addition, in an abnormal state, the switching frequency is set to a predetermined lower limit and the "on" period of the switching elements is reduced.

In the above-described known discharge-lamp lighting apparatus, after a high-voltage discharge lamp (hereinafter also called a lamp) is started, a constant drive current is supplied until a lamp voltage is increased and the lamp power reaches a rated power. Then, after the lamp power reaches the rated power, constant-power control is performed such that the lamp power is maintained constant. The lamp voltage depends on a pressure in an arc tube, and the pressure in the arc tube is increased as the temperature is increased due to light emission of the lamp and as the number of molecules is increased due to evaporation of mercury caused by the temperature increase. If the lamp has a secondary mirror, the temperature is further increased since the emitted light is returned by the secondary mirror, and therefore the pressure in the arc tube is rapidly increased. In this case, since a constant drive current is supplied, when the lamp voltage is rapidly increased, the lamp power is also increased rapidly. The rapid increase in the lamp power causes a rapid increase in a collision load placed on electrode tips by electrons in the arc tube, which leads to melting of the electrode tips. When the electrode tips melt, discharge arc is increased and the illumination is reduced.

SUMMARY

In light of the above-described problems, an advantage of some aspects of the present invention is to provide a discharge-lamp lighting apparatus that can prevent a rapid increase in lamp power by controlling a drive current in the initial stage of lighting and that can suppress melting of electrode tips and reduction in illumination, and a projector including the discharge-lamp lighting apparatus.

A discharge-lamp lighting apparatus according to an aspect of the present invention includes a direct-current power supply circuit that receives a direct-current voltage and performs current control for supplying predetermined electric power to a high-pressure discharge lamp; an inverter that converts a current outputted from the direct-current power supply circuit into an alternating current with a predetermined frequency and supplies a drive current to the high-pressure discharge lamp; an igniter that is connected to an output terminal of the inverter and that generates a high voltage at the start of lighting to start the high-pressure discharge lamp; a voltage detection circuit that detects a voltage corresponding to a lamp voltage of the high-pressure discharge lamp; a current detection circuit that detects a current corresponding to the drive current of the high-pressure discharge lamp; and a control unit for controlling the direct-current power supply circuit, the inverter, and the igniter. After the high-pressure discharge lamp is started by the igniter, the control unit determines electric power supplied to the high-pressure discharge lamp in accordance with the voltage corresponding to the lamp voltage detected by the voltage detection circuit and the drive current detected by the current detection circuit. When the determined electric power is less than predetermined electric power, the control unit causes the direct-current power supply circuit to control the drive current such that a rate of increase in the electric power supplied to the high-pressure discharge lamp becomes equal to or less than a predetermined value. In the present invention, since the drive current is controlled such that the rate of increase in the electric power supplied to the high-pressure discharge lamp becomes equal to or less than the predetermined value, the lamp power can be prevented from being rapidly increased along with the lamp voltage at the start of lighting the lamp. As a result, melting of electrode tips in the lamp and reduction in illumination can be suppressed.

In the above-described discharge-lamp lighting apparatus, when the electric power supplied to the high-pressure discharge lamp is less than the predetermined electric power, the control unit may cause the direct-current power supply circuit to control the drive current such that the rate of increase in the electric power supplied to the high-pressure discharge lamp becomes equal to the predetermined value. In this case, since the drive current is controlled such that the rate of increase in the electric power supplied to the high-pressure discharge lamp becomes equal to the predetermined value, the lamp power can be prevented from being rapidly increased along with the lamp voltage at the start of lighting. As a result, melting of electrode tips in the lamp and reduction in illumination can be suppressed.

In the above-described discharge-lamp lighting apparatus, when the electric power supplied to the high-pressure discharge lamp is less than the predetermined electric power, the control unit may cause the direct-current power supply circuit to reduce the drive current supplied by the direct-current power supply circuit with time. In this case, since the drive current supplied by the direct-current power supply circuit is reduced with time, the lamp power can be prevented from being rapidly increased along with the lamp voltage at the start of lighting. As a result, melting of electrode tips in the lamp and reduction in illumination can be suppressed.

In the above-described discharge-lamp lighting apparatus, when the electric power supplied to the high-pressure discharge lamp reaches the predetermined electric power, the control unit may cause the direct-current power supply circuit to control the drive current such that the electric power supplied to the high-pressure discharge lamp is maintained at the predetermined electric power. When the direct-current power supply circuit is caused to control the drive current in this manner, the electric power supplied to the high-pressure discharge lamp can be maintained at the predetermined electric power after the electric power supplied to the high-pressure discharge lamp reaches the predetermined electric power.

In the above-described discharge-lamp lighting apparatus, the high-pressure discharge lamp to which the direct-current power supply circuit supplies the drive current may be provided with a secondary mirror. In such a case, the direct-current power source circuit controls the drive current supplied to the high-pressure discharge lamp having the secondary mirror. Accordingly, even when the lamp voltage is rapidly increased due to a temperature increase caused by light reflected and returned by the secondary mirror, the lamp power can be prevented from being rapidly increased. Therefore, melting of electrode tips in the lamp and reduction in illumination can be suppressed.

According to another aspect of the present invention, a projector includes a high-pressure discharge lamp that has or does not have a secondary mirror; the above-described discharge-lamp lighting apparatus; a spatial light modulator; an optical system for guiding light from the high-pressure discharge lamp to the spatial light modulator; and a projecting unit for projecting an image formed by the spatial light modulator onto a screen. In the discharge-lamp lighting apparatus, the drive current is controlled such that the rate of increase in the electric power supplied to the high-pressure discharge lamp becomes equal to or less than the predetermined electric power. Therefore, discharge arc can be prevented from being increased due to melting of the electrode tips in the high-pressure discharge lamp and reduction of illumination can be reduced.

DESCRIPTION OF EXEMPLARY EMBODIMENTS

First Embodiment

Figure 1:
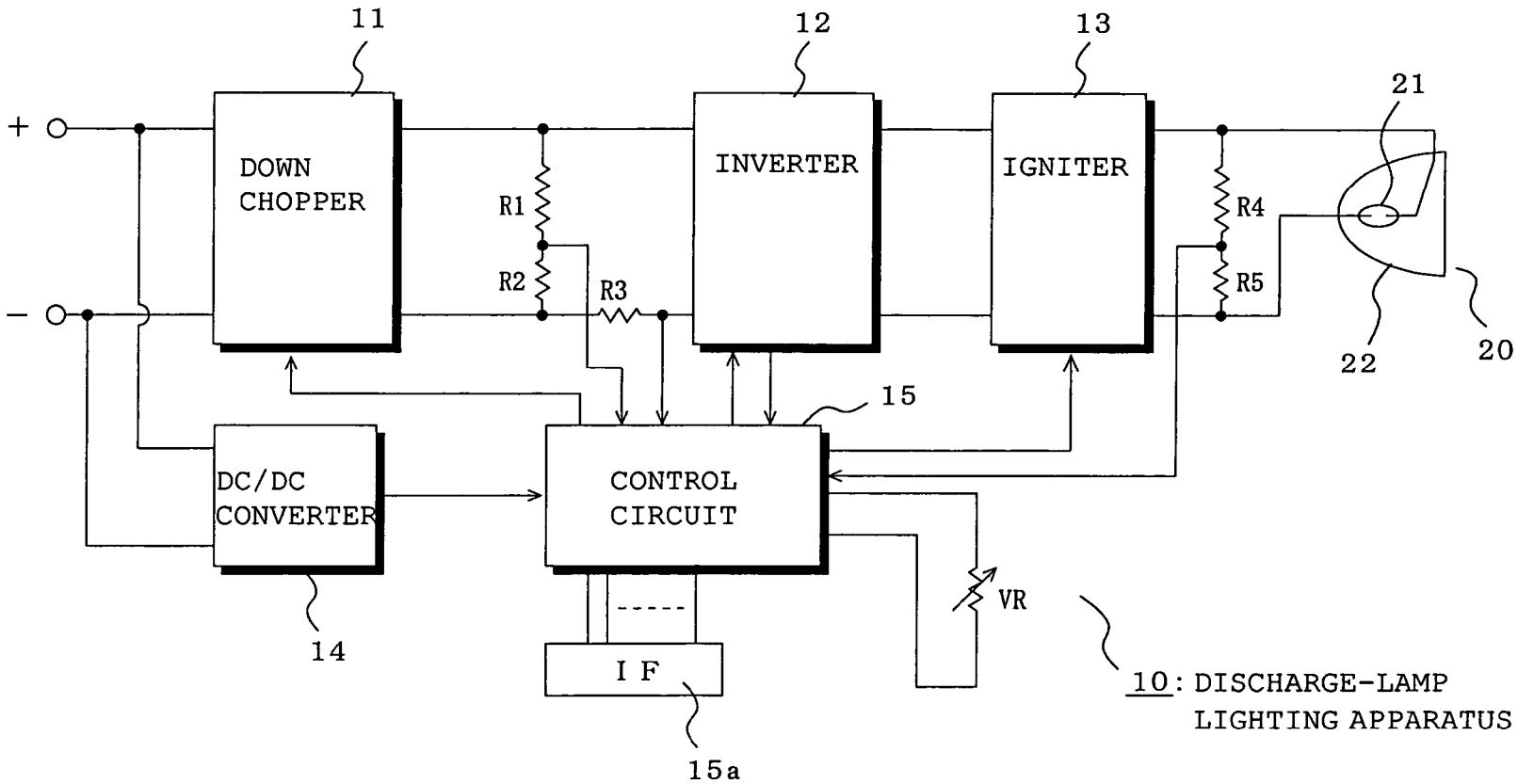
FIG. 1 is a block diagram illustrating the structure of a discharge-lamp lighting apparatus according to a first embodiment of the preset invention.

FIG. 1 is a block diagram illustrating the structure of a discharge-lamp lighting apparatus 10 according to a first embodiment of the preset invention. The discharge-lamp lighting apparatus 10 shown in FIG. 1 includes a down chopper 11, an inverter 12, an igniter 13, a DC/DC converter 14, and a control circuit 15, which functions as control unit. A lamp 20 is connected to output terminals of the igniter 13. The down chopper 11 corresponds to a direct-current power supply circuit according to the present invention, and functions to adjust an input direct-current voltage inputted to supply electric power to the lamp 20, which functions as a high-voltage discharge lamp. In this example, the input voltage is reduced by a chopper process and current control is performed by an operation for supplying electric power to the lamp 20, which will be described below. An output current outputted from the down chopper 11 is supplied to the inverter 12. Resistors R1 and R2 are connected to output terminals of the down chopper 11, and a potential at the connection point between the resistors R1 and R2 is supplied to the control circuit 15 as an output voltage of the down chopper 11. A resistor R3, which functions as a current detection circuit, is connected in series to a negative-potential terminal of the down chopper 11. A current that flows through the resistor R3 is detected as a drive current (hereinafter also called a lamp current) and is supplied to the control circuit 15.

The inverter 12 includes, for example, four switching elements connected in a full-bridge configuration, and alternate switching is performed so that the input direct-current voltage is converted into an alternating voltage. The thus-obtained alternating voltage is outputted to the igniter 13. The igniter 13 includes an igniter transformer and a drive circuit thereof, and functions to generate a high voltage and apply the generated high voltage to the lamp 20 when the lamp 20 is started. In addition, resistors R4 and R5 are connected to the output terminals of the igniter 13. Thus, a voltage detection circuit for detecting a potential at the connection point between the resistors R4 and R5 as a lamp voltage is obtained. The thus-detected lamp voltage is supplied to the control circuit 15. The DC/DC converter 14 generates a drive voltage for the control circuit 15 by reducing an input voltage, and supplies the drive voltage to the control circuit 15. The control circuit 15 includes, for example, a microprocessor or the like and controls the down chopper 11, the inverter 12, and the igniter 13. The control circuit 15 determines lamp power supplied to the lamp 20 on the basis of the detected lamp voltage and the detected lamp current, and controls the output current of the down chopper 11 by performing an operation described below. In addition, the control circuit 15 adequately controls the output frequency of the inverter 12 and causes the igniter 13 to generate a high voltage at the start of lighting the lamp 20. An external control IF 15*a* for receiving control signals from an external device and a variable resistor VR for adjusting the frequency are connected to the control circuit 15. The lamp 20 is, for example, a reflection type light source which includes a reflector 22 and an arc tube 21 fixed at the center of the reflector 22 with heat-resistant cement.

The operation of the discharge-lamp lighting apparatus shown in FIG. 1 will now be described. The down chopper 11 performs a chopper process to reduce a direct current voltage inputted thereto. The output current outputted from the down chopper 11 is inputted to the inverter 12. The inverter 12 converts the input direct current into an alternating current with a predetermined frequency and outputs the alternating current to the igniter 13. When the lamp 20 is started, the igniter 13 generates a high voltage and applies the high voltage to the lamp 20. Then, after the lamp 20 is lit, the output voltage of the inverter 12 is directly applied to the lamp 20 to maintain the lit state. The control circuit 15 receives the lamp voltage and the lamp current of the lamp 20 and controls the down chopper 11 so as to prevent the electric power of the lamp 20 from being rapidly increased, as described below. The relationship between a rapid increase in the lamp power and the lamp voltage at the start of lighting the lamp 20 will be described below.

First, the relationship between the lamp voltage and the lamp pressure at the start of lighting will be described. As is clear from the equation of state $PV=nRT$, the lamp pressure P is proportional to the temperature T and the number n of molecules in the arc tube. In the above-mentioned equation, V is the volume of the inner space of the arc tube and R is the gas constant. The temperature T in the arc tube is increased due to irradiation. As the temperature is increased, mercury in the arc tube is evaporated and the number n of molecules is increased. If the lamp has a secondary mirror, the temperature T is further increased since the emitted light is reflected and returned by the secondary mirror. As a result, the lamp pressure P is rapidly increased. The lamp voltage varies in accordance with the lamp pressure, and is rapidly increased when the lamp pressure is rapidly increased. The relationship between the rapid increase in the lamp voltage of the lamp having the secondary mirror and the lamp power will be described below.

Figure 2:
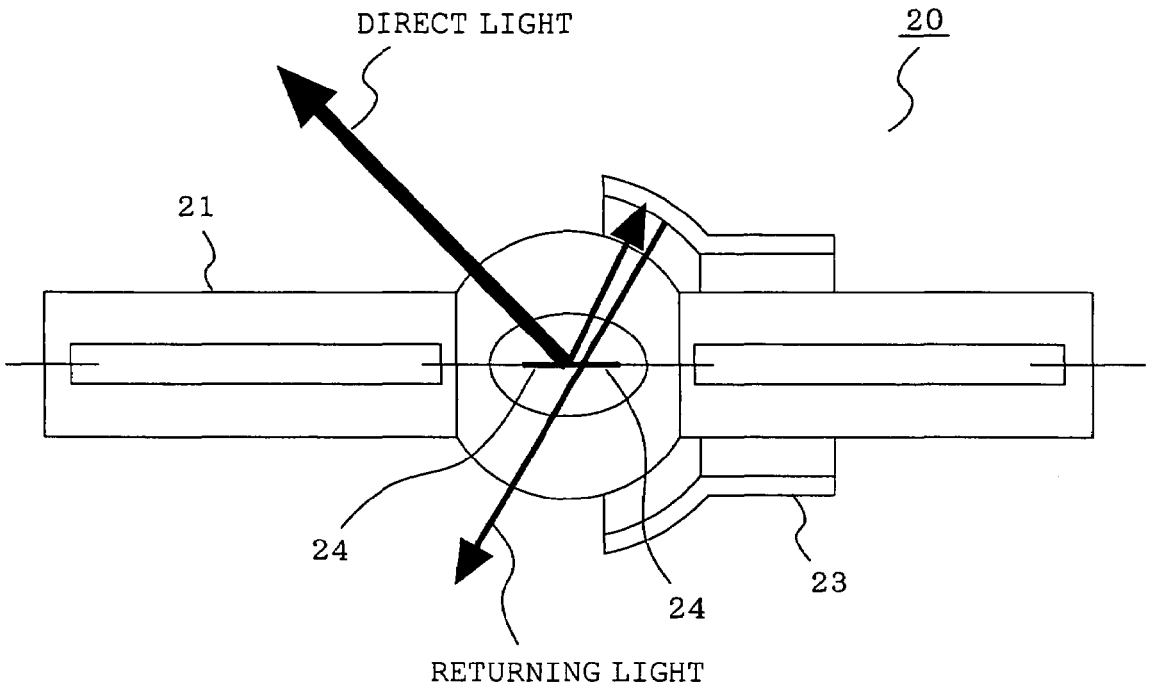
FIG. 2 is a diagram illustrating light returning from a secondary mirror in a lamp having the secondary mirror.

FIG. 2 is a diagram illustrating light returning from the secondary mirror in the lamp having the secondary mirror. In FIG. 2, the lamp 20 is, for example, a high-pressure mercury lamp. Mercury, inert gas, a small amount of halogen and the like, as well as electrodes 24 are sealed in the arc tube 21. A secondary mirror 23 reflects emitted light so as to return the light to the reflector 22 (not shown in FIG. 2) through the inner space of the arc tube 21. The arc tube 21 is not limited to the high-pressure mercury lamp, and other kinds of lamps, such as a metal halide lamp and a xenon arc lamp, may also be used. As shown in FIG. 2, in the lamp 20, light is emitted due to discharge between the electrodes 24 and is reflected by the secondary mirror 23. The reflected returning light passes through the arc tube 21. The arc tube 21 generates heat as the returning light passes therethrough, and accordingly the temperature in the arc tube 21 is further increased.

Figure 3:
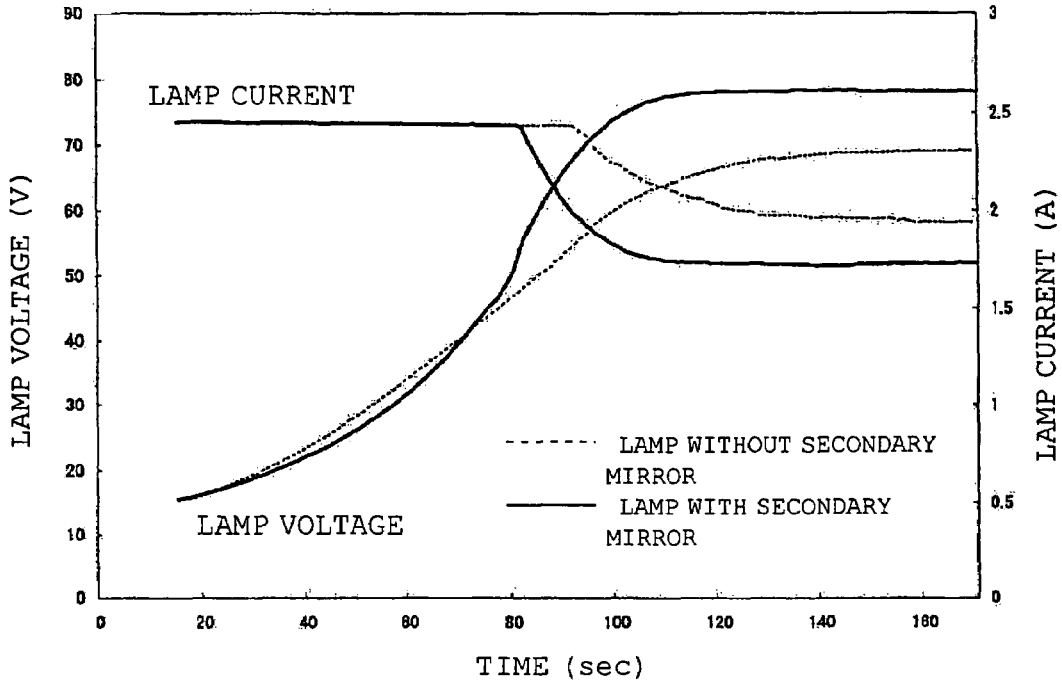
FIG. 3 is a graph showing the lamp voltage and the lamp current of the lamp having the secondary mirror.
Figure 4:
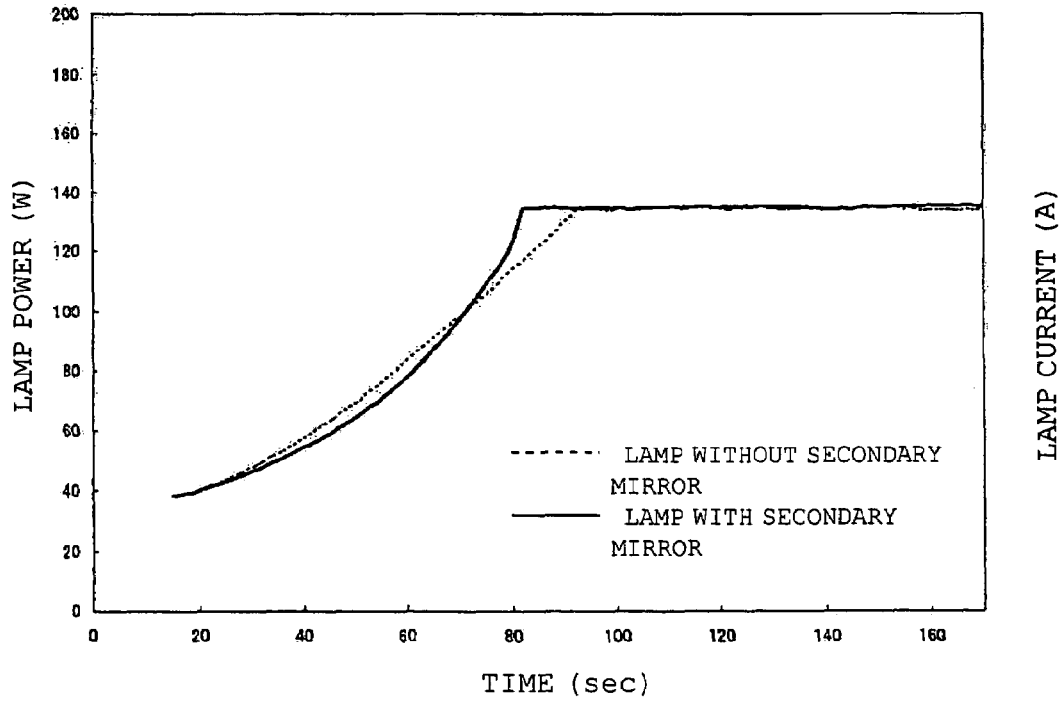
FIG. 4 is a graph showing the lamp power of the lamp having the secondary mirror.

FIG. 3 is a graph showing the lamp pressure and the lamp current of the lamp having the secondary mirror. FIG. 4 is a graph showing the lamp power of the lamp having the secondary mirror. Referring to FIG. 3, after the start of the lamp, the lamp voltage is increased as the lamp pressure is increased as described above and is stabilized at the rated voltage. The lamp voltage of the lamp having the secondary mirror is more rapidly increased than the lamp without secondary mirror. In the known discharge-lamp lighting apparatus, after the start of the lamp, the lamp current is maintained at a constant drive current until the lamp power reaches rated power (for example, 135 W). Then, after the lamp power reaches the rated power, constant power control is performed such that the lamp power is maintained constant. Therefore, as shown in FIG. 4, the lamp power determined in accordance with the lamp voltage and the lamp current is rapidly increased along with the rapid increase in the lamp voltage until the lamp power reaches the rated power. The rapid increase in the lamp power causes a rapid increase in a collision load of electrons placed on electrode tips in the arc tube, so as to lead to melting of the electrode tips. When the electrode tips melt, discharge arc is increased and the illumination is reduced.

To suppress melting of the electrode tips and the reduction in illumination due to the rapid increase in the lamp power, it is necessary to control the lamp current such that the lamp power is prevented from being rapidly increased. The detailed control operation of the lamp current will be described below with reference to FIGS. 5 and 6.

Figure 5:
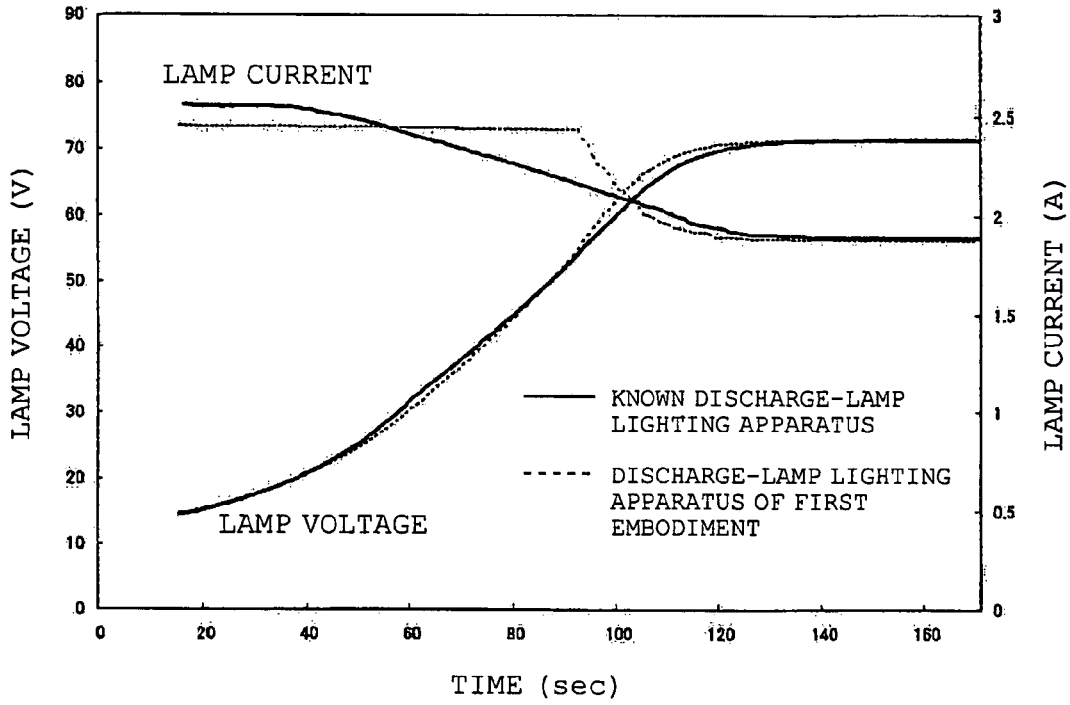
FIG. 5 is a graph showing the lamp voltage and the lamp current according to the first embodiment of the present invention.
Figure 6:
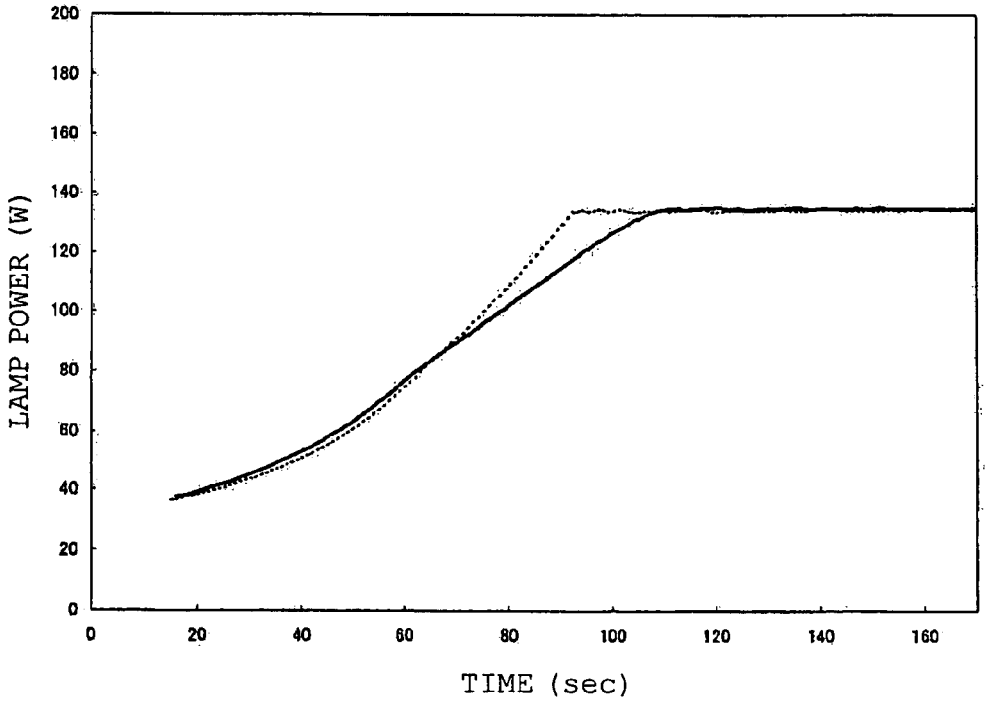
FIG. 6 is a graph showing the lamp power according to the first embodiment of the present invention.

FIG. 5 is a graph showing the lamp voltage and the lamp current according to the first embodiment of the present invention. FIG. 6 is a graph showing the lamp power according to the first embodiment of the present invention. After the lamp 20 is started by the igniter 13, the control circuit 15 calculates the lamp power by multiplying the lamp voltage detected by the voltage detection circuit by the lamp current detected by the current detection circuit. Then, when the lamp power is less than predetermined electric power (the rated power), e.g. 135 W, an amount of increase in the lamp voltage per unit time, namely, a rate of increase in the lamp voltage, is determined. Then, a lamp current is so determined that the amount of increase in the lamp power per unit time, namely, the rate of increase in the lamp power, becomes equal to or less than a predetermined value. The control circuit 15 causes the down chopper 11 to perform current control such that the determined lamp current is supplied to the lamp 20. Then, when the lamp power is increased along with the lamp voltage and reaches the predetermined electric power, the control circuit 15 causes the down chopper 11 to control the lamp current such that constant power is supplied to the lamp 20. As shown in FIG. 6, in the discharge-lamp lighting apparatus according to the present embodiment, since the down chopper 11 is caused to control the lamp current, such that the rate of increase in the lamp power becomes equal to or less than the predetermined value, the lamp power is prevented from being rapidly increased. In comparison, in the known discharge-lamp lighting apparatus that performs constant current control in which constant current is supplied after the start of the lamp, the lamp power is rapidly increased.

As described above, if the temperature is increased due to light emitted by the lamp 20 and light returned by the secondary mirror after the start of the lamp 20, the lamp pressure is rapidly increased. Accordingly, the lamp voltage is also rapidly increased. In such a case, according to the present embodiment, the control circuit 15 determines the lamp power supplied to the lamp 20 and causes the down chopper 11 to control the lamp current, so as to prevent the lamp power from being rapidly increased. Thus, the lamp power is prevented from being rapidly increased and a collision load of electrons placed on the electrode tips in the lamp 20 due to a rapid increase in the lamp power can be reduced. As a result, melting of the lamp electrodes is suppressed. Accordingly, discharge arc can be prevented from being increased due to melting of the electrode tips and reduction in illumination can be suppressed.

According to the above-described explanation, the rate of increase in the lamp power is set to be equal to or less than a predetermined value. However, the present invention is not limited to this as long as the lamp power can be prevented from being rapidly increased along with the lamp voltage. For example, the lamp current may also be controlled such that the rate of increase in the lamp power becomes equal to a predetermined constant value.

Alternatively, for example, after the lamp 20 started by the igniter 13, the control circuit 15 may cause the down chopper 11 to reduce the lamp current with time in the case when the lamp power is less than the predetermined electric power.

Alternatively, for example, a table showing the lamp current corresponding to the lamp voltage and the rate of increase thereof may be prepared in advance. In such a case, the lamp current can be controlled by referring to the table. In addition, the lamp current may be changed discretely.

In the above-described embodiment, the case in which a drive current is supplied to a lamp having a secondary mirror is described as an example. However, the present invention is not limited to this, and may also be applied to a lamp without a secondary mirror.

Second Embodiment

Figure 7:
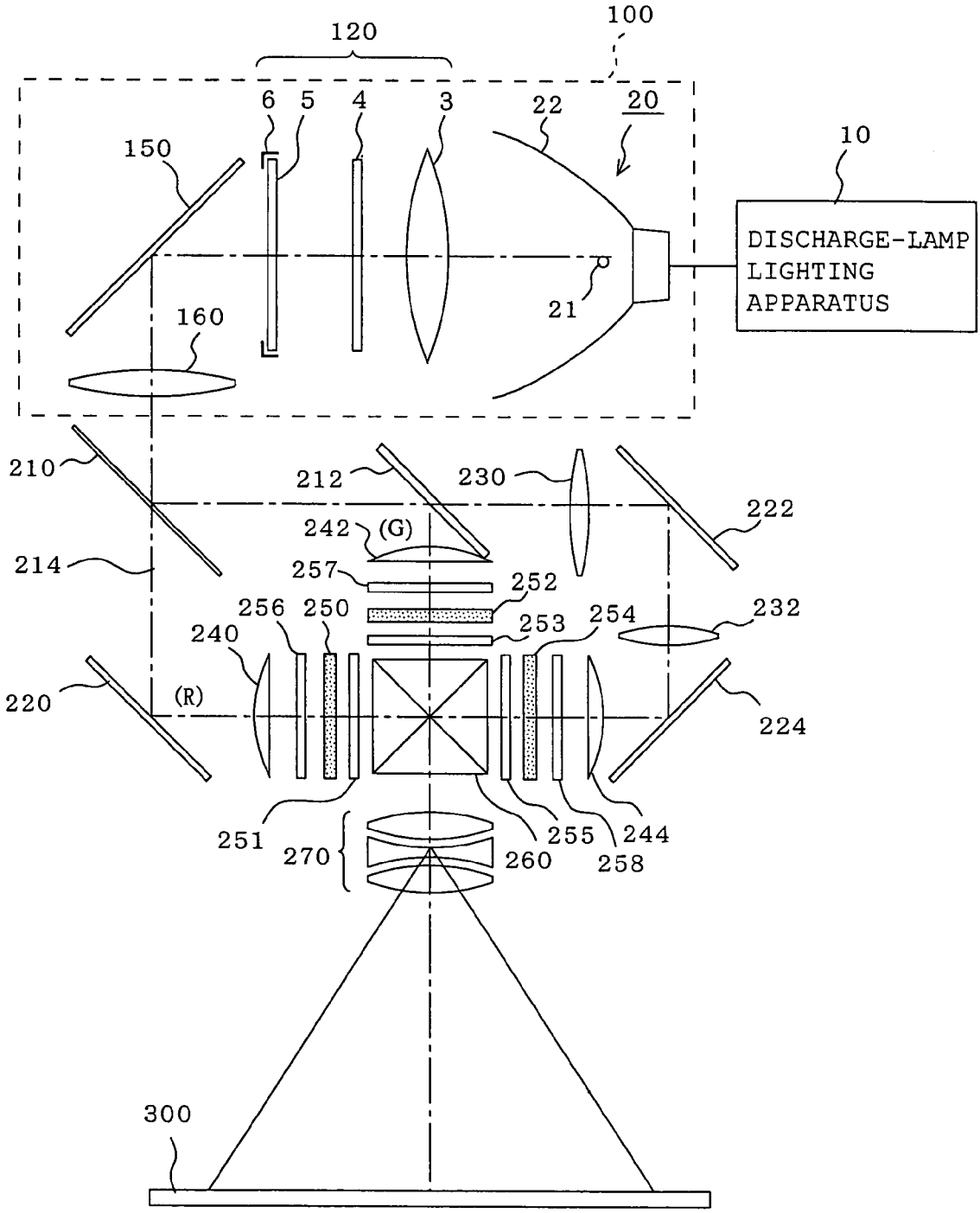
FIG. 7 is an optical structure diagram of a projector according to a second embodiment of the present invention.

FIG. 7 is an optical structure diagram of a projector according to a second embodiment of the present invention. In the projector according to the present embodiment, the discharge-lamp lighting apparatus according to the above-described first embodiment is included in an illumination optical system. In FIG. 7, a discharge-lamp lighting apparatus 10 corresponds to that shown in FIG. 1.

The projector includes an illumination optical system 100, dichroic mirrors 210 and 212, reflective mirrors 220, 222, and 224, an incident lens 230, a relay lens 232, three field lenses 240, 242, and 244, three liquid crystal panels 250, 252, and 254, which function as spatial modulators, polarizers 251, 253, 255, 256, 257, and 258, which are provided on the exit side and the entrance side of the respective liquid crystal panels, a cross dichroic prism 260, and a projection lens 270.

The illumination optical system 100 includes a lamp 20 that emits a substantially parallel light beam, an illuminating device 120, a reflective mirror 150, and a condenser lens 160. The lamp 20 includes a reflector 22 and an arc tube 21 with a secondary mirror that functions as a radiation light source to emit radial light. Light emitted from the lamp 20 passes through the illuminating device 120, where the brightness of the light is made uniform, and enters the condenser lens 160 via the reflection mirror 150. The condenser lens 160 causes the uniform light emitted from the illuminating device 120 to be incident on the liquid crystal panels 250, 252, and 254.

Two dichroic mirrors 210 and 212 form a color-separation optical system 214 that separates the light emitted from the illumination optical system 100 into red (R) light, green (G) light, and blue (B) light. The first dichroic mirror 210 transmits a red light component of the light emitted from the illumination optical system 100 and reflects blue and green light components.

Thus, red light passing through the first dichroic mirror 210 is reflected by the reflection mirror 220, and reaches the liquid crystal panel 250 for red light through the field lens 240. This field lens 240 has a function of collecting light rays passing therethrough such that each light ray becomes parallel to the principal ray (center axis). The field lenses 242 and 244 disposed in front of the other liquid crystal panels provide a similar function.

Blue light and green light are reflected by the first dichroic mirror 210. The green light is reflected by the second dichroic mirror 212, passes through the field lens 242, and reaches the liquid crystal panel 252 for green light. The blue light passes through the second dichroic mirror 212, and then passes through a relay lens system including the incident lens 230, the relay lens 232, and the reflective mirrors 222 and 224. Then, the blue light passing through the relay lens system further passes through the field lens 244 and reaches the liquid crystal panel 254 for blue light.

Each of the three liquid crystal panels 250, 252, and 254 functions as a light modulator that converts the light incident thereon into light for forming an image in accordance with a received image signal. The polarizers 256, 257, and 258 are disposed on the entrance sides of the liquid crystal panels 250, 252, and 254, respectively, and the polarizers 251, 253, and 255 are disposed on the exit sides of the liquid crystal panels 250, 252, and 254, respectively. The polarizers function to adjust the polarizing direction of light that passes therethrough. The red light, the green light, and the blue light that pass through the liquid crystal panels 250, 252, and 254, respectively, enter the cross dichroic prism 260.

The cross dichroic prism 260 functions as a color combining optical system that combines the red light, the green light, and the blue light emitted from the liquid crystal panels 250, 252, and 254, respectively. In the cross dichroic prism 260, a dielectric multilayer film that reflects red light and a dielectric multilayer film that reflects blue light are arranged in a substantially X shape along interfaces of four right-angle prisms. The red light, the green light, and the blue light are combined by the dielectric multilayer films, and the thus-combined light is used for projecting a color image. The combined light generated by the cross dichroic prism 260 passes through a projection lens 270 and is projected onto a projection screen 300. Accordingly, images displayed on the liquid crystal panels 250, 252 and 254 are projected onto the screen 300.

In the second embodiment, a light is separated into three colored lights. However, the separation of the light may be determined according to the specification of a projector. Also, the number of liquid crystal panel used in a projector may be properly determined based on the specification.

As described above, the projector according to the second embodiment includes the discharge-lamp lighting apparatus according to the first embodiment, and the lamp 20 lit by the discharge-lamp lighting apparatus is used in the illumination optical system. Therefore, the lamp power can be prevented from being rapidly increased when the lamp 20 is started and melting of the electrode tips in the lamp 20 can be suppressed. Accordingly, reduction in the illumination of the lamp 20 can be suppressed and the brightness of the image projected onto the projection screen 300 can be maintained.

The entire disclosure of Japanese Patent Application No. 2006-087698, filed Mar. 28, 2006, is expressly incorporated by reference herein.

What is claimed is:

1. A discharge-lamp lighting apparatus comprising:

a direct-current power supply circuit that controls a current for supplying predetermined electric power to a high-pressure discharge lamp;

an inverter that converts the current outputted from the direct-current power supply circuit into a drive current and supplies the drive current to the high-pressure discharge lamp;

an igniter that generates a high voltage at a start of lighting the high-pressure discharge lamp;

a voltage detection circuit that detects a voltage of the high-pressure discharge lamp;

a current detection circuit that detects the drive current of the high-pressure discharge lamp; and a control unit for controlling the direct-current power supply circuit, the inverter, and the igniter, wherein, after the start of lighting, the control unit determines electric power to be supplied to the high-pressure discharge lamp in accordance with the voltage detected by the voltage detection circuit and the drive current detected by the current detection circuit, and wherein, during a period from the start of lighting to a time when the electric power determined by the control unit grows to a predetermined electric value, the control unit controls the drive current such that a rate of increase in the electric power supplied to the high-pressure discharge lamp becomes equal to or less than a predetermined rate.

2. The discharge-lamp lighting apparatus according to claim 1, wherein, during a period from the start of lighting to a time when the electric power determined by the control unit grows to the predetermined electric power, the control controls the drive current such that the rate of increase in the electric power supplied to the high-pressure discharge lamp per unit time becomes equal to the predetermined rate.

3. The discharge-lamp lighting apparatus according to claim 1, wherein, during a period from the start of lighting to a time when the electric power grows to the predetermined electric power, the control unit reduces the drive current supplied by the direct-current power supply circuit with time.

4. The discharge-lamp lighting apparatus according to claim 1, wherein, when the electric power supplied to the high-pressure discharge lamp reaches the predetermined electric power, the control controls the drive current such that the electric power supplied to the high-pressure discharge lamp is maintained at the predetermined electric power.

5. The discharge-lamp lighting apparatus according to claim 1, wherein the high-pressure discharge lamp to which the direct-current power supply circuit supplies the drive current is provided with a secondary mirror.

6. A projector comprising:

a high-pressure discharge lamp;

the discharge-lamp lighting apparatus according to claim 1;

at least one spatial light modulator;

an optical system for guiding light from the high-pressure discharge lamp to the spatial light modulator; and a projecting unit for projecting an image formed by the spatial light modulator onto a screen.

7. A projector comprising:

a high-pressure discharge lamp;

the discharge-lamp lighting apparatus according to claim 2;

at least one spatial light modulator;

an optical system for guiding light from the high-pressure discharge lamp to the spatial light modulator; and a projecting unit for projecting an image formed by the spatial light modulator onto a screen.

8. A projector comprising:

a high-pressure discharge lamp;

the discharge-lamp lighting apparatus according to claim 3;

at least one spatial light modulator;

an optical system for guiding light from the high-pressure discharge lamp to the spatial light modulator; and a projecting unit for projecting an image formed by the spatial light modulator onto a screen.

9. A projector comprising:

a high-pressure discharge lamp;

the discharge-lamp lighting apparatus according to claim 4;

at least one spatial light modulator;

an optical system for guiding light from the high-pressure discharge lamp to the spatial light modulator; and a projecting unit for projecting an image formed by the spatial light modulator onto a screen.

10. A projector comprising:

a high-pressure discharge lamp;

the discharge-lamp lighting apparatus according to claim 1;

at least one spatial light modulator;

an optical system for guiding light from the high-pressure discharge lamp to the spatial light modulator; and a projecting unit for projecting an image formed by the spatial light modulator onto a screen.

* * * * *